United States Patent [19]

Oda et al.

[11] Patent Number: 4,580,533

[45] Date of Patent: Apr. 8, 1986

[54] VALVE MECHANISM HAVING VARIABLE VALVE TIMING

[75] Inventors: Hiroyuki Oda; Shunji Masuda; Yasuyuki Morita, all of Hiroshima, Japan

[73] Assignee: Mazda Motor Corporation, Hiroshima, Japan

[21] Appl. No.: 592,423

[22] Filed: Mar. 22, 1984

[30] Foreign Application Priority Data

Mar. 24, 1983 [JP] Japan ..... 58-49570

[51] Int. Cl.[4] ..... F01L 1/34

[52] U.S. Cl. ..... 123/90.16; 123/90.48

[58] Field of Search ..... 123/90.16, 90.48

[56] References Cited

U.S. PATENT DOCUMENTS

| | | | |
|---|---|---|---|
| 2,260,983 | 10/1941 | Walker | 123/90.16 |
| 3,385,274 | 5/1968 | Shunta et al. | 123/90 |
| 3,422,803 | 1/1969 | Stivender | 123/90.16 |
| 3,704,696 | 12/1972 | Abell, Jr. | 123/90.33 |
| 4,285,310 | 8/1981 | Takizawa et al. | 123/308 |
| 4,347,812 | 9/1982 | Kosuda et al. | 123/90.16 X |
| 4,442,806 | 4/1984 | Matsuura et al. | 123/198 F |
| 4,466,390 | 8/1984 | Babitzka et al. | 123/90.16 |

FOREIGN PATENT DOCUMENTS

| | | | |
|---|---|---|---|
| 2901186 | 7/1980 | Fed. Rep. of Germany | 123/90.16 |
| 1245669 | 10/1960 | France | 123/90.16 |
| 52-35819 | 6/1977 | Japan | 123/90.16 |
| 52-35816 | 9/1977 | Japan | 123/90.16 |
| 6659 | 3/1929 | United Kingdom | 123/90.16 |
| 6650 | 8/1931 | United Kingdom | 123/90.16 |
| 955988 | 4/1964 | United Kingdom | 123/90.16 |
| 1303080 | 1/1973 | United Kingdom | 123/90.16 |

*Primary Examiner*—William R. Cline
*Assistant Examiner*—Peggy A. Neils
*Attorney, Agent, or Firm*—Fleit, Jacobson, Cohn & Price

[57] ABSTRACT

A valve mechanism for an internal combustion engine has a valve and a cam on a camshaft for operating the valve. A swingable member is provided for swinging movement about the camshaft and has a tappet receiving hole. A tappet slidably received in the hole is driven by the cam and in turn drives the valve. The valve timing can be changed by swingably moving the swingable member. A control device is provided for holding the swingable member at a position wherein the direction of movement of the tappet is aligned with the direction of movement of the valve under a heavy load, high speed engine operation and moving the swingable member to another position wherein the direction of movement of the tappet is inclined with respect to the direction of movement of the valve under a light load, low speed operation to change the valve timing.

7 Claims, 12 Drawing Figures

VALVE MECHANISM HAVING VARIABLE VALVE TIMING

FIELD OF THE INVENTION

The present invention relates in general to an internal combustion engine and more particularly to valve timing control means for internal combustion engines.

DESCRIPTION OF PRIOR ART

In an internal combustion engine, it is in general desirable to change the timings of the intake and exhaust valves in accordance with the engine operating conditions. For example, in a heavy load operation, it is required to make the opening period of the intake valve as long as possible to thereby increase the intake charge, however, an increase in the opening period of the intake valve can cause a blow back of the intake mixture under a heavy load, low speed operation. It is therefore necessary to determine the intake valve timing taking into account not only the engine load but also the engine speed. It should further be noted that the overlap period between the intake and exhaust valve timings must be as small as possible under a light load operation in order to obtain stable combustion and consequently decreasing the idling speed, because a decrease in the overlap period is effective to decrease the quantity of residual gas. However, a decrease in the overlap period leads to a decrease in the opening period of the intake valve so that there will be a shortage of intake charge under a heavy load operation. It is therefor recommendable to increase the valve overlap period for a heavy load, high speed operation. Even if the valve overlap period is increased, there will be produced no serious problem under a heavy load, high speed operation because the intake gas flow has a relatively large inertia.

In view of the above, it has been proposed to change the engine valve timings in accordance with the engine operating conditions. For example Japanese patent publication No. 52-35819 discloses a valve timing control mechanism which includes a planetary gear mechanism provided between the engine output shaft and the valve actuating cam shaft and a centrifugal governor associated with the planetary gear mechanism for producing a phase change between the engine output shaft and the cam shaft to thereby change the valve timing. However, the proposed device is disadvantageous in that the mechanism is complicated and the valve timings can be controlled only in accordance with the engine speed. As an alternative solution, there has also been proposed to provide a cam shaft with a cam having an axially changing profile. In this mechanism, the valve timing can be adjusted by moving the cam shaft in an axial direction. However, this is also disadvantageous in that the camshaft has to be axially moved so that there will be problems in respect of response to a change in the engine operating condition and reliability of the mechanism.

In view of the foregoing problems in the known valve timing control mechanisms, the applicants have proposed by the U.S. patent application Ser. No. 530,740 filed on Sept. 9, 1983 a valve timing control mechanism including a swingable member mounted for swinging movement about the axis of the camshaft. The swingable movement is formed with a hole in which a valve actuating tappet is axially slidably received. By swingably moving the swingable member about the axis of the camshaft, it is possible to change the contact point between the cam and the tappet member at a given angular position of the camshaft to thereby change the valve timing. The proposed mechanism is believed as being relatively simple. However, depending on the position of the swingable member, the direction of movement of the tappet is inclined with respect to the direction of movement of the valve stem so that slipping movements are produced at the contact surfaces between the tappet and the valve stem. This may lead to a problem of wear of the contact surfaces.

SUMMARY OF THE INVENTION

It is therefore an object of the present invention to provide means for suppressing wear of the valve tappet and the valve stem in a valve timing control mechanism wherein a slip between the valve tappet and valve stem is unavoidably produced.

Another object of the present invention is to provide, in a valve timing control mechanism having a swingable member swingable about the axis of the camshaft and slidably supporting the valve tappet, means for minimizing wear of contact surfaces between the valve tappet and the valve stem.

According to the present invention, the above and other objects can be accomplished by a valve mechanism for an internal combustion engine comprising a camshaft rotatable about a longitudinal axis and having a cam formed thereon, a swingable member mounted for swinging movement about the longitudinal axis of the camshaft and formed with a tappet receiving hole, a valve tappet received in said tappet receiving hole for a slidable movement along the tappet receiving hole, said tappet having a cam engaging surface at one end and a stem engaging surface at the other end, a valve stem mounted for axial movement and engaged at one end with said stem engaging surface of the tappet to be actuated thereby, valve timing control means for swingably moving said swingable member in accordance with engine operating conditions to thereby change valve timing, said control means including means for holding said swingable member at a position wherein the direction of the slidable movement of the tappet is aligned with the direction of the axial movement of the valve stem at least under a heavy load, high speed engine operation, and for moving said swingable member from said position to another position under a low speed engine operation to effect a change in valve timing.

It is considered that wear of the contact surfaces between the valve stem and the tappet are produced mostly due to slips at the contact surfaces, and the amount of wear depends on the contact pressure and the sliding speed between the contact surfaces. In order to decrease the wear at the contact surfaces between the tappet and the valve stem, it is therefore necessary to decrease the PV value, which is a product of the contact pressure P and the sliding speed V between the contact surfaces. According to the present invention, the swingable member and therefore the direction of movement of the tappet is oriented so that there will be no slip between the contact surfaces under a heavy load, high speed operation wherein the valve stem speed is high. It is therefore possible to decrease the PV value and consequently the wear of the contact surfaces.

In a preferable aspect of the present invention, the control means includes means for holding the swingable member at the first mentioned position not only under a heavy load, high speed engine operation but also under a light load, high speed engine operation. In other engine operating conditions, the swingable member is moved from the first mentioned position to change the valve timing.

DESCRIPTION OF PREFERRED EMBODIMENTS

Figure 1:
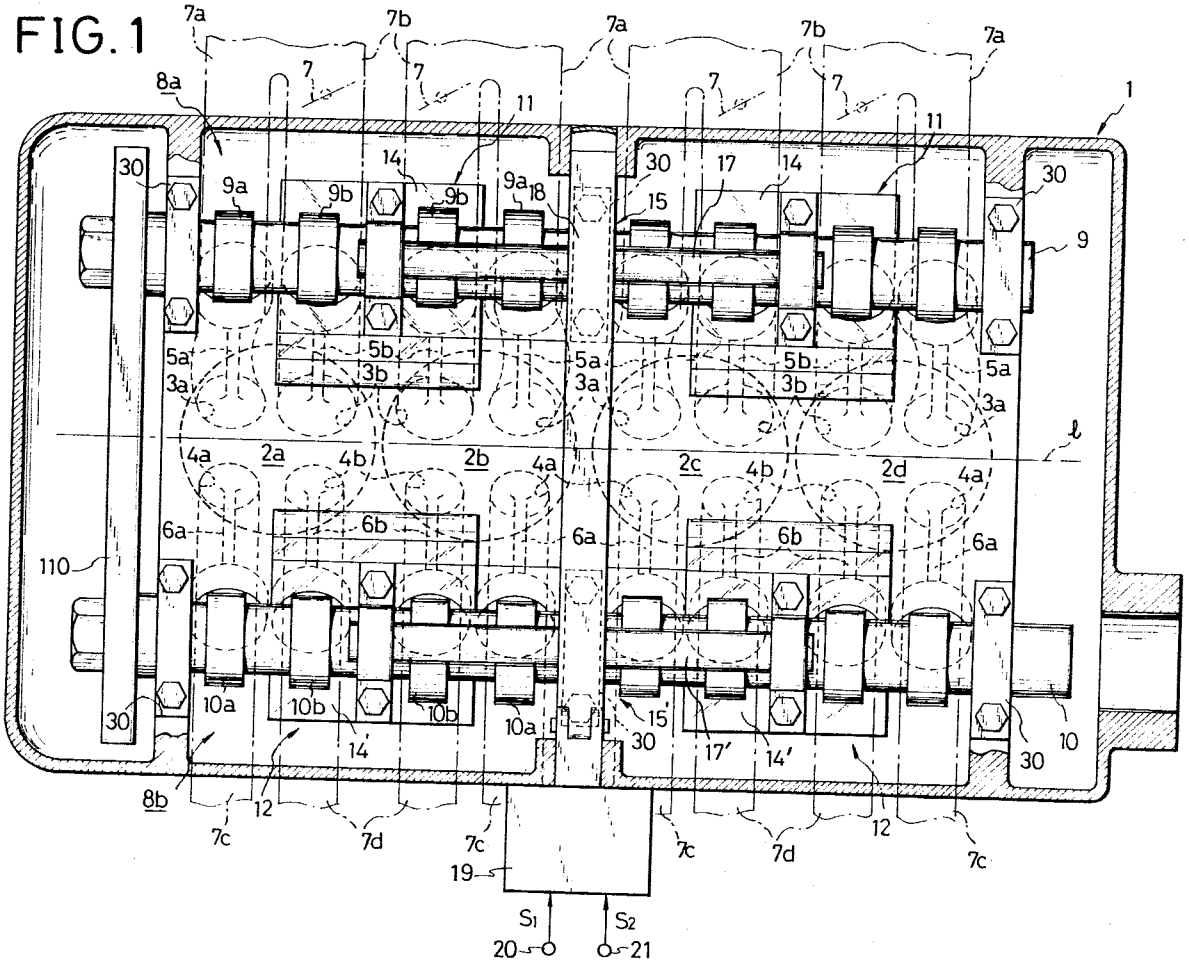
FIG. 1 is a plan view of a valve mechanism for a four cylinder engine to which the present invention is applied.
Figure 2:
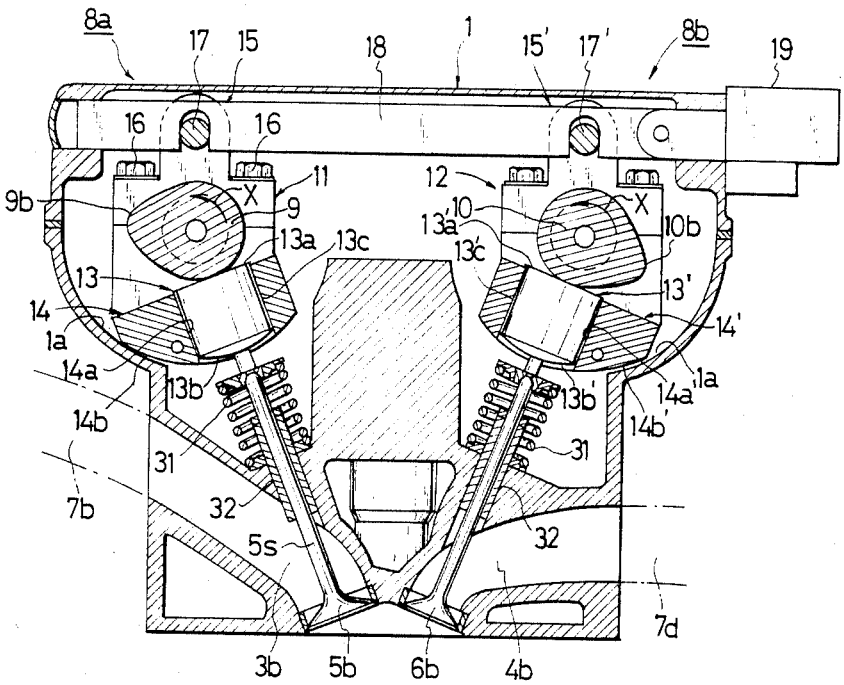
FIG. 2 is a cross-sectional of the valve mechanism shown in FIG. 1.

Referring to FIGS. 1 and 2, there is shown an embodiment in which the present invention is applied to a four cylinder engine having a dual induction type intake system including light load and heavy load intake valves for each cylinder. The engine has an engine body 1 which is formed with first to fourth cylinders 2*a* to 2*d* which are aligned along a center line 1 of the body 1. In each of the cylinders 2*a* to 2*d*, there are formed a pair of intake ports 3*a* and 3*b* and a pair of exhaust ports 4*a* and 4*b*. The intake port 3*a* is for a light load operation whereas the intake port 3*b* is for a heavy load operation and these ports 3*a* and 3*b* are arranged in a direction parallel with the center line 1. The exhaust ports 4*a* and 4*b* are also arranged in a direction parallel with the center line. The heavy load ports 3*b* for the first and second cylinders 2*a* and 2*b* are adjacent to each other. The exhaust ports 4*b* for the first and second cylinders 2*a* and 2*b* are also adjacent to each other. For the third and fourth cylinders 2*c* and 2*d*, the heavy load intake ports 3*b* are located adjacent to each other and the exhaust ports 4*b* are adjacent to each other.

The intake ports 3*a* and 3*b* for each cylinder are provided with intake valves 5*a* and 5*b*, respectively. The exhaust ports 4*a* and 4*b* for each cylinder are similarly provided with exhaust valves 6*a* and 6*b*, respectively. The intake ports 3*a* and 3*b* for each of the cylinders 2*a* to 2*d* are respectively connected with a light load and heavy load intake passage 7*a* and 7*b* which lead to a common passage. The heavy load intake passage 7*b* is provided with a shut-off valve 7 which is closed under a light load engine operation so that the intake gas is supplied under a light load operation only through the passage 7*a* and the light load intake port 3*a* communicating with the passage 7*a*. Under a heavy load operation, the shut-off valve 7 is opened so that the intake gas is supplied through the passages 7*a* and 7*b* and the intake ports 3*a* and 3*b*. The exhaust ports 4*a* and 4*b* for each cylinder are respectively connected with exhaust passages 7*c* and 7*d*.

At the upper portion of the engine body 1, there are provided an intake valve actuating mechanism 8*a* for actuating the intake valves 5*a* and 5*b* and an exhaust valve actuating mechanism 8*b* for actuating the exhaust valves 6*a* and 6*b*. The intake valve actuating mechanism 8*a* includes an intake camshaft 9 which is arranged in parallel with the center line 1 and connected with the engine crankshaft (not shown) through a timing belt 110. The camshaft 9 has cams 9*a* and 9*b* for cooperation with the intake valves 5*a* and 5*b*, respectively, so that the valves 5*a* and 5*b* are driven as the camshaft 9 is rotated.

The exhaust valve actuating mechanism 8*b* includes a camshaft 10 which is arranged in parallel with the center line 1 and connected with the engine crankshaft to be driven thereby through the timing belt 110. The camshaft 10 is formed with cams 10*a* and 10*b* for cooperation with the exhaust valves 6*a* and 6*b*, respectively, so that the valves 6*a* and 6*b* are operated as the camshaft 10 is rotated.

The intake valve actuating mechanism 8*a* includes a pair of first valve timing changing mechanisms 11, one for the heavy load intake valves 5*b* of the first and second cylinders 2*a* and 2*b* and the other for the valves 5*b* of the third and fourth cylinders 2*c* and 2*d*. Similarly, the exhaust valve actuating mechanism 8*b* includes a pair of second valve timing changing mechanisms 12, one for the exhaust valves 6*b* of the first and second cylinders 2*a* and 2*b* and the other for the valves 6*b* of the third and fourth cylinders 2*c* and 2*d*. The mechanisms 11 and 12 have the same structures so that only the mechanism 11 will be described with reference to FIGS. 2 and 3. As shown, the mechanism 11 includes a swingable member 14 which has a pair of tappet receiving holes 14*a* for slidably receiving valve tappets 13. The swingable member 14 is mounted on the camshaft 9 through a bearing 9*c* for swingable movement about the longitudinal axis of the camshaft 9. For the purpose, the swingable member 14 has a mounting bracket 14*c* which is divided into two parts at the bearing 9*c* and secured together by means of bolts 16. The tappet receiving holes 13 are spaced apart from each other along the length of the camshaft 9 by a distance corresponding to the spacing between the heavy load intake ports 3*b* of two adjacent cylinders. The intake valves 5*b* associated with the intake ports 3*b* have valve stems 5*s* which are slidably mounted on the cylinder head through sleeves 32. Compression springs 31 are provided for forcing the intake valves 5*b* into closed positions. The valve stems have upper ends respectively engaged with the tappets 13 received in the tappet receiving holes 14*a* in the swingable member 14. Further, the cams 9*b* on the camshafts 9 are respectively engaged with the valve tappets 13. For the purpose, each of the valve tappets 13 has a flat top surface 13*a* for engagement with the cam 9*b* and a bottom surface 13*b* for engagement with the top end of the valve stem. The bottom surface 13*b* of the tappet 13 is of a part-spherical configuration. Further, the valve tappet 13 has a cylindrical barrel 13*c* which is slidably engaged with the hole 14*a* in the swingable member 14. The swingable member 14 has a bottom surface 14*b* having an arcuate cross-sectional configuration with the center of the arc on the axis of the camshaft 9. The cylinder head is formed with a surface 1*a* of an annular cross-sectional configuration for accommodating the bottom surface 14*b* of the swingable member 14.

The mechanism 11 further includes an actuating device 15 which comprises a rod 17 passing through the mounting brackets 14*c* of the swingable members 14 and a push rod 18 extending perpendicularly to the rod 17 and engaged therewith. An actuating device is provided for axially moving the push rod 18. An axial movement of the push rod 18 causes a sideward displacement of the rod 17 and, since the rod 17 is offset from the camshaft 9, the member 14 is swung in response to an axial movement of the push rod 18. The actuating device 19 is operated by an output from a control circuit which receives an engine speed signal $S_1$ from a speed detector 20 and an engine load signal $S_2$ from a load detector 21.

Figure 4:
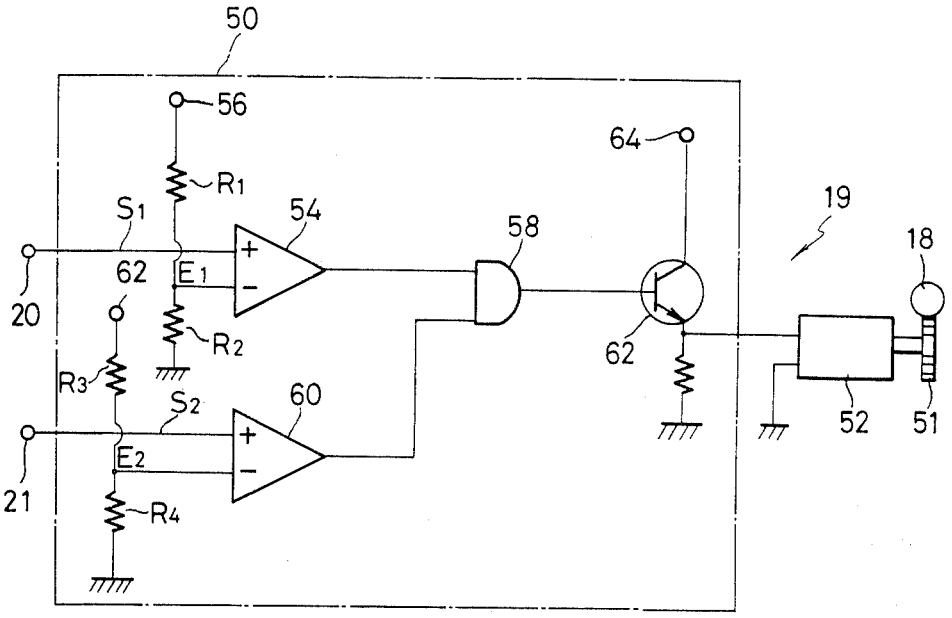
FIG. 4 is a diagram of a control circuit for changing the valve timing.

Referring to FIG. 4, it will be noted that the actuating device 19 includes a control circuit 50 which receives the signals $S_1$ and $S_2$ from the detectors 20 and 21 and produces an output for operating a motor 52 connected through a gear 51 with the push rod 18. The speed signal $S_1$ is applied to a positive input terminal of a comparator 54 in the circuit 50. The comparator 54 has a negative input terminal connected with a power source terminal 56 through a voltage divider including resistors $R_1$ and $R_2$ so that a reference voltage $E_1$ is applied thereto. Thus, the comparator 54 functions to compare the speed signal $S_1$ with the reference voltage $E_1$ and produces a high level signal when the speed signal $S_1$ is larger than the reference voltage $E_1$. The output of the comparator 54 is applied to an AND circuit 58.

Figure 5:
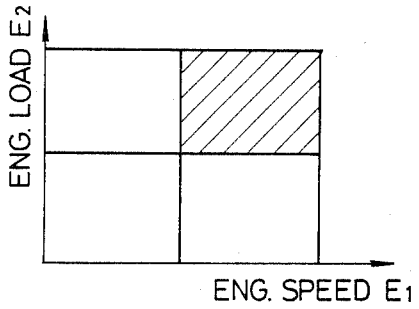
FIG. 5 is a diagram showing examples of changing the valve timing in accordance with the engine load and the engine speed.

The control circuit 50 further includes a comparator 60 which has a positive input terminal applied with the load signal $S_2$ from the load detector 21 and a negative input terminal connected with a power source terminal 62 through a voltage divider including resistors $R_3$ and $R_4$ so that a reference voltage $E_2$ is applied thereto. The comparator 60 functions to compare the load signal $S_2$ with the reference voltage $E_2$ and produces a high speed signal when the load signal $S_2$ is larger than the reference voltage $E_2$. The output of the comparator 60 is applied to the AND circuit 58. The AND circuit 58 has an output connected with the base of a NPN type transistor 62 having a collector connected with a power source terminal 64 and an emitter connected with the motor 52. Thus, when the AND circuit 58 receives high level signals from the comparators 54 and 60, the transistor 62 becomes conductive and the motor 52 is energized to move the push rod 18 axially in one direction. Thus, the swingable member 14 is swung about the camshaft 9 to change the valve timing. It will be understood that the motor 52 is energized only under an engine operating condition wherein the engine speed and the engine load are high as shown by a shadowed area in FIG. 5. There is provided a suitable return mechanism such as a spring acting on the push rod 18 for returning the push rod 18 to the initial position when either one or both of the outputs from the comparators 54 and 60 turn to low level.

Figure 6:
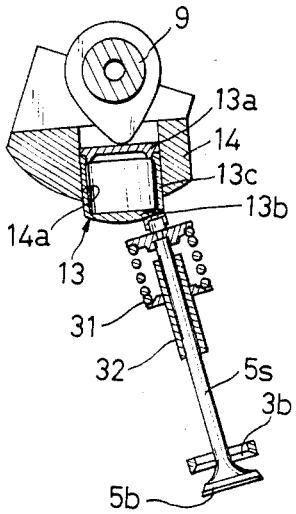
FIGS. 6 and 7 are sectional views showing the swingable member in different positions.
Figure 7:
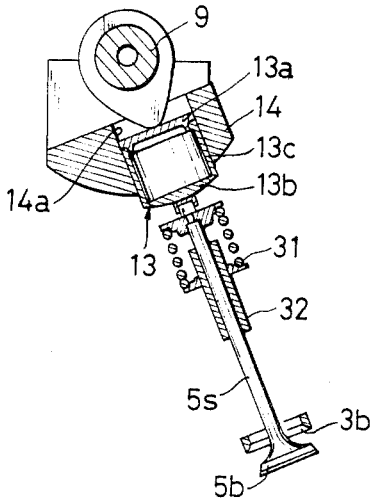

Referring to FIG. 6, it will be noted that the axis of the tappet receiving hole 14*a* and therefore the direction of movement of the valve tappet 13 is inclined with respect to the valve stem 5*s*. In this position, the valve stem 5*s* is axially driven by the valve tappet 13 in response to axial movements of the tappet 13 while producing slipping movement along the part-spherical bottom surface 13*b*. FIG. 7 shows a position in which the direction of movement of the valve tappet 13 is aligned with the valve stem 5*s*. In this position, the valve stem 5*s* is driven by the valve tappet 13 without any slip. In the illustrated embodiment of the present invention, the swingable member 14 is maintained in the position shown in FIG. 6 when the motor 52 is de-energized, but it is swung to the position shown in FIG. 7 when motor 52 is energized.

Figure 8:
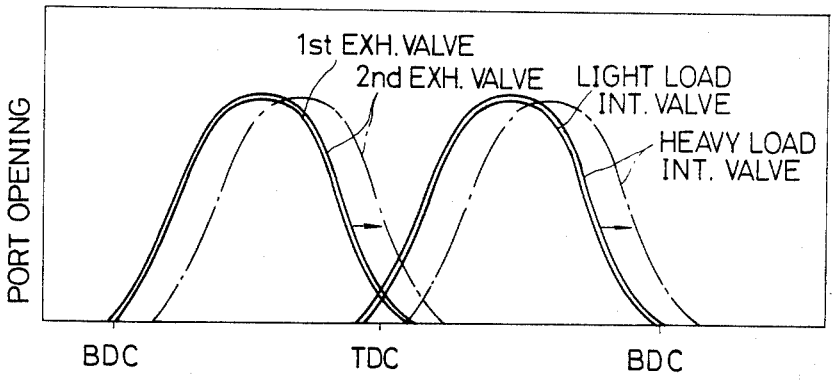
FIG. 8 is a diagram showing the intake and exhaust valve timings in the embodiment shown in FIG. 1.

In operation, when both of the engine speed and engine load are lower than the predetermined values, the AND circuit 58 produces a low level output so that the motor 52 is deenergized and the swingable member 14 takes the position shown in FIG. 6. In this position, the first and second exhaust valves 6*a* and 6*b* are opened substantially simultaneously at the bottom dead center and closed slightly after the top dead center as shown by solid lines in FIG. 8. Similarly, the intake valves 5*a* and 5*b* are opened slightly before the top dead center with a small overlap period with the exhaust valves 6*a* and 6*b* and closed substantially the the bottom dead center as shown by solid lines in FIG. 8. Further, the heavy load intake passage 7*b* is closed by the shut-off valve 7 so that the intake gas is introduced only through the light load intake port 3*a*.

Under a heavy load, low speed engine operation, the shut-off valve 7 is opened so that the intake gas is introduced through both of the intake ports 3*a* and 3*b*. However, since the AND circuit 58 continues to produce a low level output due to the low engine speed, the valve timings remain unchanged. It is therefore possible to prevent blow back of the intake gas since there is only a little overlap period between the exhaust and intake valves.

When both the engine speed and engine load exceed the predetermined values, the AND circuit 58 produces a high level output so that the motor 52 is energized. Thus, the swingable member 14 in each valve timing changing mechanism is swung to the position shown in FIG. 7 so that the valve timings for the associated valves 5*b* and 6*b* are retarded as shown by phantom lines in FIG. 8. Since the timing of the light load intake valve 5*a*, is not changed, the retarded timing of the exhaust valve 6*b* causes an increase in the overlap period. Further, the retarded timing of the heavy load intake valve 5*b* results in an increase in the intake period. As a result, it is possible to increase the intake charge for a heavy load, high speed engine operation. Since the swingable member 14 takes the position as shown in FIG. 7 under heavy load, high speed operation, there will be no slip between the valve tappet and the valve stem. Under low speed operation, there will be produced slip between the valve tappet and the valve stem. However, since the valve speed is relatively low, there will be no serious problem of wear. In the aforementioned embodiment, it is possible to control the valve timing only in accordance with the engine speed.

Figure 3:
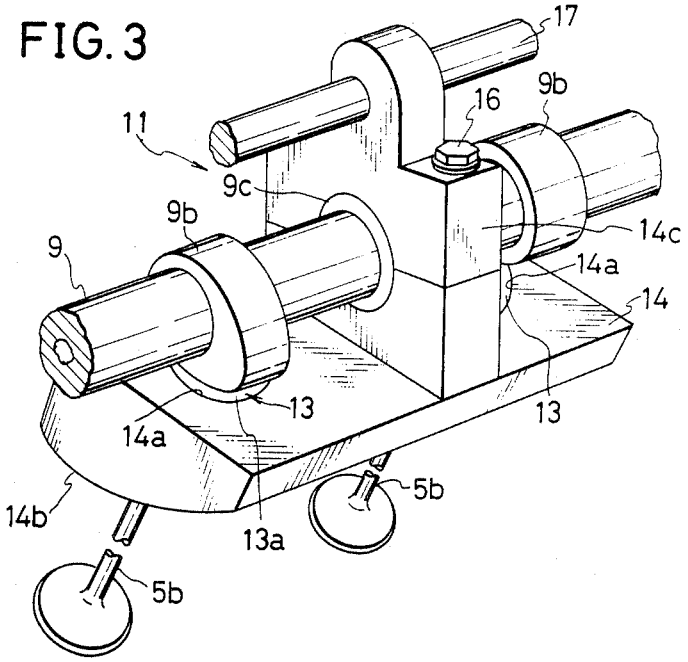
FIG. 3 is a perspective view of the valve timing control mechanism adopted in the embodiment shown in FIGS. 1 and 2.
Figure 9:
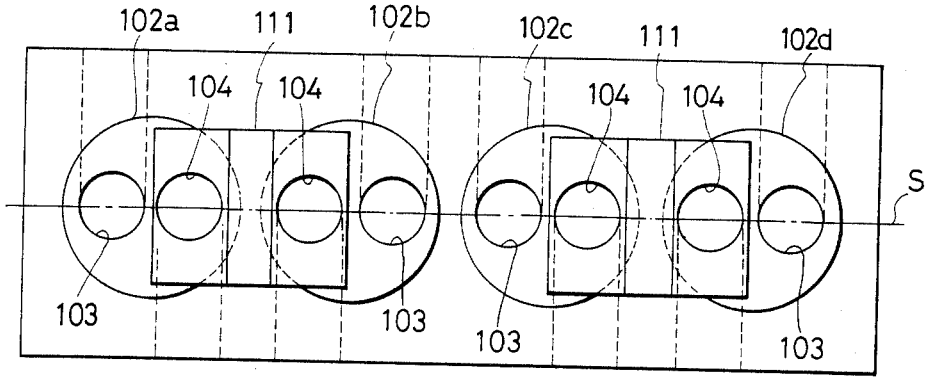
FIG. 9 is a diagrammatical plan view of a four cylinder engine to which the present invention is applied.
Figure 10:
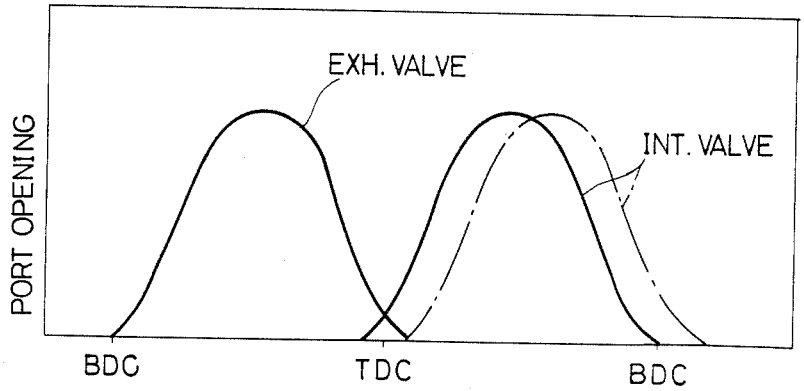
FIG. 10 is a diagram showing the intake and exhaust valve timings in the embodiment shown in FIG. 9.

Referring to FIG. 9, there is shown another example of a four cylinder engine which includes first to fourth cylinders 102*a* to 102*d* each provided with a single intake port 103 and a single exhaust port 104. The exhaust ports 104 for the first and second cylinders 102*a* and 102*b* and those for the third and fourth cylinders 102*c* and 102*d* are respectively located adjacent to each other and a valve timing changing mechanism 111 similar to the mechanism 11 shown in FIG. 3 is provided for each pair of the exhaust ports 104. Alternatively, the intake ports 103 may be paired so as to be associated with the valve timing changing mechanism 111. FIG. 10 shows an example wherein the intake valve timing is changed in this manner as shown by a phantom line under a heavy load, high speed operation. In the embodiments described above, the valve timing changing mechanism is constructed so that it controls two valves, however, it should be noted that each of the valves may be provided with a valve timing changing mechanism.

Figure 11:
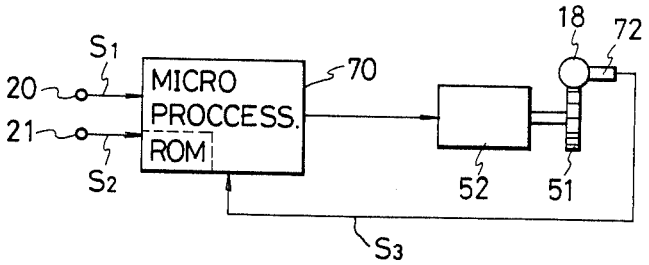
FIG. 11 is a block diagram of the valve timing control system in accordance with another embodiment of the present invention; and, FIG. 12 is a program flow chart showing the control in the embodiment shown in FIG. 11.
Figure 12:
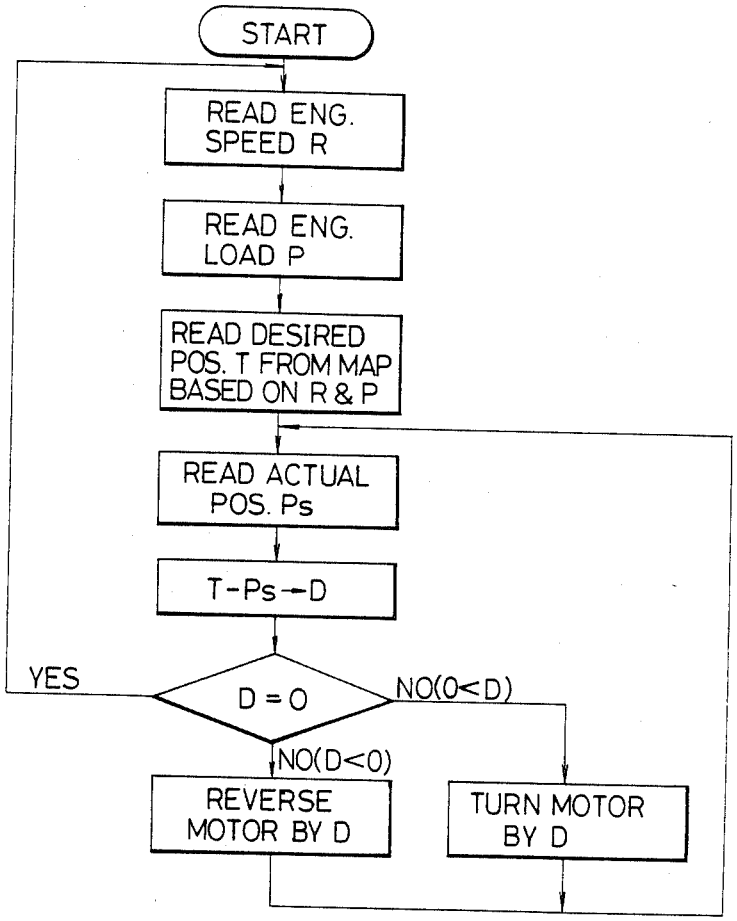

Referring now to FIG. 11, there is shown an example in which the valve timing changing mechanism is controlled by a microprocessor 70. The microprocessor 70 is arranged so as to receive a speed signal $S_1$ from the engine speed detector 20, a load signal $S_2$ from the engine load detector 21 and a position signal $S_3$ from a position detector 72 which detects the position of the push rod 18. The microprocessor 70 is operated under the program flow as shown in FIG. 12. In this embodiment, the motor 52 is substituted by a step motor so that the push rod 18 can be moved to any desired position. The microprocessor 70 includes ROM which contains a map for determining the position of the push rod 18 under various combinations of the engine speed and the engine load. In operation, the engine speed R and the engine load P are obtained from the speed signal $S_1$ and the load signal $S_2$ and, based on the engine speed R and the engine load P thus obtained, a desired position T of the push rod 18 is read from the map. Thereafter, the desired position T is compared with the actual position of the push rod 18 which is obtained from the position signal $S_3$ to produce a motor driving signal.

The invention has thus been shown and described with reference to specific embodiments, however, it should be noted that the invention is in no way limited to the details of the illustrated arrangements and structures but changes and modifications may be made without departing from the scope of the appended claims.

What is claimed is:

1. A valve mechanism for an internal combustion engine comprising: a camshaft rotatable about a longitudinal axis and having a cam formed thereon, a swingable member mounted for swinging movement about the longitudinal axis of the camshaft and formed with a tappet receiving hole, a valve tappet received in said tappet receiving hole for a slidable movement along the tappet receiving hole, said tappet having a cam engaging surface at one end and a stem engaging surface at the other end, a valve stem mounted for axial movement and engaged at one end with said stem engaging surface of the tappet to be actuated thereby, valve timing control means for swingably moving said swingable member and said tappet about the camshaft axis in accordance with predetermined engine operating conditions to thereby change valve opening and valve closing timing, said control means including means for holding said swingable member at a first position wherein the tappet and valve stem are in contact at a first position on the stem engaging surface of said tappet and the direction of the slidable movement of the tappet is aligned with the direction of the axial movement of the valve stem at least under heavy load, high speed engine operation, and for moving said swingable member from said first position to a second position wherein the tappet and valve stem are in contact at a second position on the stem engaging surface of said tappet at low speed engine operation to effect a change in valve opening and valve closing timing.

2. A valve mechanism in accordance with claim 1 in which said valve timing control means includes means for holding the swingable member at said first position at high speed engine operation.

3. A valve mechanism in accordance with claim 1 in which said stem engaging surface of the tappet is of a part-spherical configuration.

4. A valve mechanism in accordance with claim 1 in which said valve timing control means includes actuating means for actuating said swingable member stepwisely between said first position and said second position.

5. A valve mechanism in accordance with claim 1 in which said valve timing control means includes actuating means for actuating said swingable member steplessly, and positioning means for positioning the swingable member in a desired position in accordance with a predetermined engine operating condition and for producing an output for operating said actuating means to bring said swingable member to said desired position.

6. A valve mechanism in accordance with claim 4 in which said valve timing control means includes means for holding said swingable member in said second position and means for operating said actuating means to bring said swingable member to said first position.

7. A valve mechanism in accordance with claim 5 in which said positioning means includes a memory for storing desired positions of the swingable member under various engine operating conditions, and means for accessing to the memory to obtain said desired position for a given engine operating condition.

* * * * *